United States Patent [19]

Lee

[11] 4,421,463

[45] Dec. 20, 1983

[54] DOWNHOLE PUMP

[75] Inventor: Bert Lee, Salt Lake City, Utah

[73] Assignee: Jeff D. Morgan, Edmond, Okla.

[21] Appl. No.: 290,835

[22] Filed: Jul. 8, 1981

[51] Int. Cl.[3] ..... F04B 47/08

[52] U.S. Cl. ..... 417/383

[58] Field of Search ..... 417/375, 377, 378, 391, 417/376, 383, 264

[56] References Cited

U.S. PATENT DOCUMENTS

| | | | |
|---|---|---|---|
| 129,353 | 7/1872 | Lytle . | |
| 500,856 | 7/1893 | Cox . | |
| 583,837 | 6/1897 | Bechtol . | |
| 784,991 | 4/1905 | Davitt . | |
| 1,544,898 | 7/1925 | Gage et al. . | |
| 1,568,447 | 1/1926 | Forsyth | 417/264 |
| 1,696,065 | 12/1928 | Tucker . | |
| 1,836,585 | 12/1931 | Gage . | |
| 1,907,948 | 5/1933 | Gage . | |
| 1,962,473 | 6/1934 | Atwell . | |
| 1,981,288 | 11/1934 | Ross . | |
| 2,050,526 | 8/1936 | Gleason . | |
| 2,142,773 | 1/1939 | Athey . | |
| 2,340,943 | 2/1944 | Downs . | |
| 2,342,855 | 2/1944 | Green . | |
| 2,942,552 | 6/1960 | Wayt . | |
| 2,949,857 | 8/1960 | Coberly | 417/264 |
| 3,991,825 | 11/1976 | Morgan . | |

FOREIGN PATENT DOCUMENTS

| | | | |
|---|---|---|---|
| 323827 | 1/1930 | United Kingdom | 417/264 |

*Primary Examiner*—Leonard E. Smith

*Attorney, Agent, or Firm*—Laney, Dougherty, Hessin & Beavers

[57] ABSTRACT

A downhole pump for use in a well which includes a casing, a coaxially aligning tubing within the casing for transporting fluid, and fluid filling the space between the tubing and casing. A bottom seals the casing and tubing and includes an upward-flow check valve which permits fluid flow only from beneath the bottom into the tubing. A bucket having an open top, a closed bottom and an annular fin extending from the side thereof is constrained within the tubing. The bucket bottom also includes an upward-flow check valve. A plunger mounted on the tubing over the bucket cooperates with the bucket to form a cavity, the size of which increases as the bucket moves downward within the tubing. A third upward-flow check valve is mounted on the plunger to permit fluid flow from within the bucket to the tubing over the plunger. Holes are formed in the casing between the bottom and the annular fin of the bucket to permit fluid communication between the casing and lower portion of the tubing. A pump alternately applies pressure and vacuum to the fluid between the casing and tubing thereby moving the bucket up and down and pumping fluid up the tubing.

7 Claims, 2 Drawing Figures

DOWNHOLE PUMP

BACKGROUND AND SUMMARY OF THE INVENTION

The present invention relates to pumps, and more particularly to a pump of the so-called downhole type, which can be used to pump fluid from a fluid-filled chamber underground to the surface.

Various types of pumps have been proposed for pumping fluid, e.g., water, petroleum, etc., out of wells to the surface of the ground. Such pumps typically require large amounts of power to lift fluid from a well (which can be many thousands of feet deep) to the surface. This is so because the power of the pump is used to support a column of fluid which extends from the bottom of the well to the top. The column is continuously raised by the pump thus lifting fluid from the well.

A general object of the invention is to provide a pump which lifts fluid from the base of a well without requiring the high power input of past pumps.

The usual well is drilled in the ground to a desired depth where fluid is accumulated. The drilling hole is lined with casing pipe and tubing pipe is coaxially aligned within the casing pipe, such tubing being used as a conduit for transporting the fluid from the bottom of the well to the surface. Fluid fills the space between the tubing exterior and casing interior.

According to a preferred embodiment of the invention, the base of the well is sealed by a bottom which includes a check valve that permits flow only from beneath the bottom into the tubing. Above the bottom a movable bucket is constrained within the tubing, the bucket bottom also including an upward-flow check valve. Extending from the bucket side is an annular fin. A plunger is mounted on the inside of the tubing over the bucket. When the bucket moves upwardly, the plunger extends into the bucket and fluid in the bucket is forced through an upward-flow check valve in the plunger. Holes are provided in the tubing between the bucket fin and casing bottom which permit fluid communication between the tubing interior and the casing.

In operation, a relatively low power pump is used at the top of the casing to alternately apply pressure and vacuum to the fluid between the tubing and casing. Such action alternately raises and lowers the bucket, the bucket filling as it lowers, and expelling fluid up the tubing as it raises.

A further object of the invention is to provide a low power pump as above described which does not require fluid-tight sealing between different pump chambers.

These and other objects and attendant advantages of the present invention will become apparent as further consideration is given to the following detailed description and accompanying drawings.

DETAILED DESCRIPTION OF THE INVENTION

Figure 1:
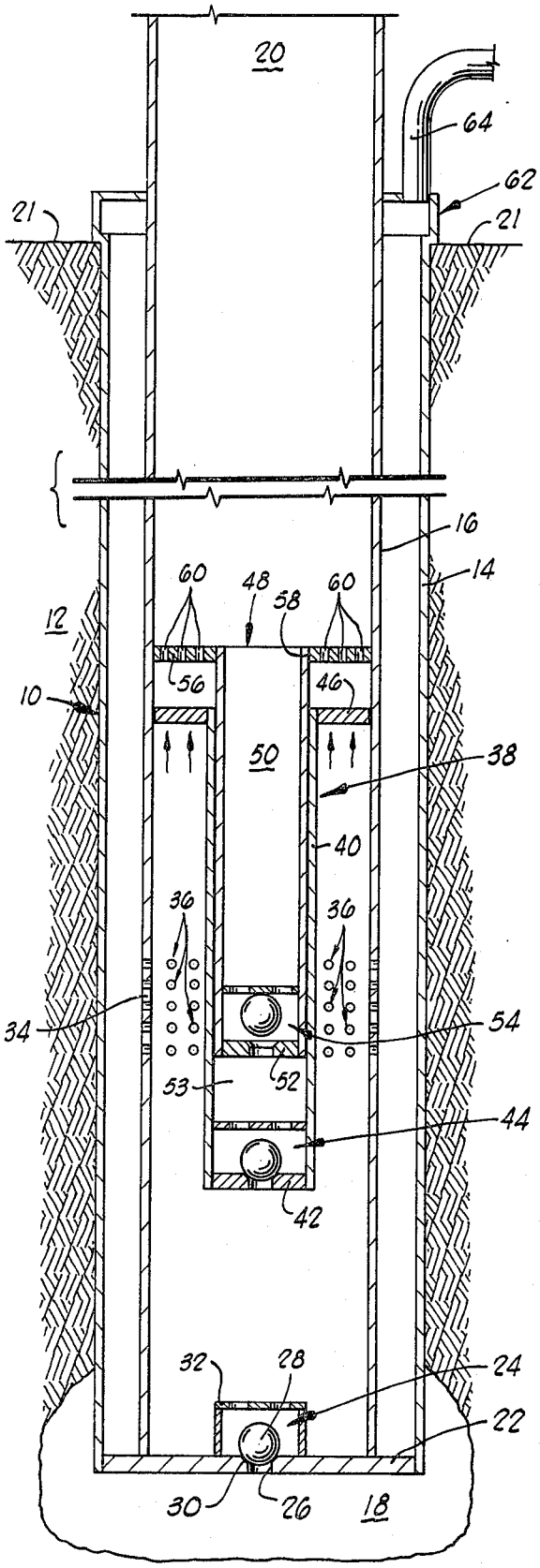
FIG. 1 is a cross-sectional view of the pump of the present invention wherein the bucket is raising.

Turning now to the drawing, the pump of the present invention is generally designated at 10. The instant embodiment of the pump is used in a well which has been drilled in the ground 12. The usual annular casing 14 lines the borehole. Likewise, the usual annular tubing 16 is coaxially aligned within the casing to provide a conduit for lifting fluid from the well.

It is to be appreciated that each of the Figures in the drawing shown only an upper portion of the well and a lower portion, such portions appearing above and below the bracket, respectively. The broken-away portion, indicated by the bracket, includes a continuous of the casing and tubing which, in some wells, may include many thousands of feet. At the bottom of the well is a fluid pool 18 upon which pump 10 will act to lift the fluid up tubing 16 to the tubing top 20 above the top of the ground 21.

At the bottom of the well, the ends of both casing 14 and tubing 16 are sealed by a circular bottom or floor 22. Floor 22 prevents fluid entry from pool 18 into casing 14 or into tubing 16, except that an upward-flow check valve, indicated generally at 24, permits (under certain conditions to be later described) fluid from the pool to enter the tubing.

Check valve 24 is of conventional structure and functions to permit fluid flow in one direction only. A hole 26 in floor 22 permits fluid communication between pool 18 and the tubing. A ball 28, in the instant pump, being made of steel, rests on a chamfer 30, provided about the top of hole 26. A so-called spider 32 is mounted on floor 22 over the hole in the ball. The spider is simply a wire mesh fixedly mounted on the floor to prevent the ball from being ejected away from the hole when fluid flows upward through the hole.

A lower portion 34 of tubing 16 includes a series of holes 36 which extend about the tubing circumference.

Located over bottom 22 and coaxially aligned within the tubing is a vessel or bucket, indicated generally at 38. The bucket includes an annular side 40, such being formed from a pipe in the instant embodiment. The bucket further includes a bottom 42 which is simply a circular disc that seals the bottom of the pipe. Mounted on bucket bottom 42 is an upward-flow check valve, indicated generally at 44. Valve 44 is conventional and is of the same structure as previously-described valve 24. Extending from side 40 is an annular fin 46. Fin 46 extends from side 40 completely around the circumference of the side and has an outside circumference slightly smaller than the inside circumference of the tubing. Fin 46 is mounted on side 40 at the top of the bucket. The top is open and permits a vessel seal or plunger 48 to extend into the bucket.

Plunger 48 includes a pipe 50 and a plunger bottom 52. The space formed by the cooperation of pipe 50 and bucket bottom 42 with plunger bottom 52 is referred to herein as a cavity 53. Mounted on the plunger bottom is an upward-flow check valve, indicated generally at 54. Valve 54 is a conventional check valve and is constructed and operates in the same manner as check valves 24, 44. Pipe 50 is coaxially aligned within the tubing and is fixedly positioned as shown by a disc 56 which is mounted on tubing 16 about its circumference. Disc 56 includes a concentric hole 58. The top of pipe 50 is mounted on the disc at its top about the circumference of the pipe and hole. Disc 56 is perforated with holes 60 which permit fluid communication between the top and the bottom of the disc. The top of pipe 50 is open. Thus, as will later be more fully explained, when fluid moves upward through valve 54, flow continues through pipe 50 and into the tubing above disc 56.

At the top of the well, a conventional seal 62 seals the top of the casing to the outside of tubing 16 about their circumferences. Tubing top 20 is connected in a conventional manner to a storage tank (not shown) which accumulates quantities of fluid pumped from the well. A manifold 64 is attached to a conventional two-stroke pump (not shown). The manifold communicates between the pump and the space formed by the outside of tubing 16 and the inside of casing 14. The pump is of a type that includes a piston which, when extended, increases the pressure in manifold 64 (and in the space formed between the tubing and casing). When the piston is withdrawn, the pressure in the manifold, and hence the formed space, decreases.

It is to be appreciated that in operation, tubing 20 in filled with fluid throughout its length—both above and below disc 56 and above and below fin 46. Likewise, both cavity 53 and the space between the casing and tubing are also filled with fluid at all times during operation of the pump of the instant invention.

Consideration will first be given to what might be thought of as the first stroke of the pump of the instant invention. The conventional pump (not shown) connected to manifold 64 begins extension of its piston thereby increasing fluid pressure in the manifold and in the fluid between casing 14 and tubing 16. Such pressure causes fluid to flow into the tubing through holes 36. This fluid flow increases the pressure in the tubing beneath the bucket. Thus, valve 24 closes, preventing fluid movement from pool 18 into the tubing. As the pressure builds, the bucket begins to move upward as a result of pressure increase on the bottom side of fins 46. The diameter of pipe 50 with respect to the tubing and the size of the holes in valves 44 and 54 are selected so that upward movement of the bucket causes a rapid increase in pressure in cavity 53. Such selection of sizes may be easily accomplished by one skilled in the art. Since the pressure formed in cavity 53 increases with upward movement of the bucket, valve 44 closes, preventing fluid passage therethrough. On the other hand, the high pressure in cavity 53 causes valve 54 to open, thus ejecting the fluid in the bucket into pipe 50 and thence upward into the tubing. Holes 60 in disc 56 permit the upper surface of fin 46 to displace the fluid in its path thus permitting the bucket to rise to its uppermost position, that occurring when fin 46 abuts the underside of disc 56. At that position, substantially all of the contents of the bucket have been ejected through pipe 50 up tubing 20. At some time after the bucket has reached its uppermost position, the two-stroke pump attached to manifold 64 begins its second stroke wherein its piston is withdrawn thus lowering the pressure in manifold 64 and in the space between the tubing and casing.

Figure 2:
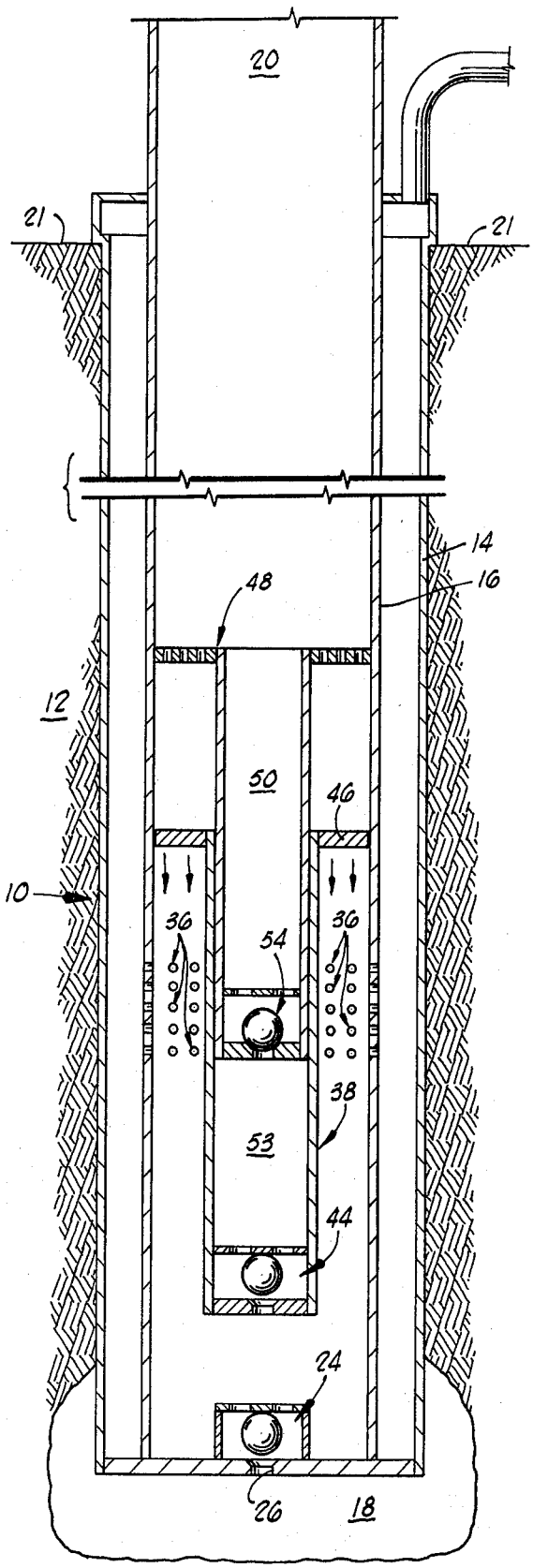
FIG. 2 is a cross-sectional view of the pump of the present invention wherein the pump bucket is lowering.

FIG. 2 illustrates the condition of valves 24, 44, and 54 when the pump of the instant invention is in its second stroke wherein the bucket is moving downward. As the pressure in the space between tubing 16 and casing 14 drops, fluid begins to flow from the inside of the tubing to the outside through holes 36. Such flow lowers the pressure in the tubing beneath the bucket thus permitting valve 24 to open and drawing fluid from pool 18 into the tubing. The size of hole 26 is selected so that, although fluid is drawn into the tubing from pool 18, enough fluid is leaving the tubing via holes 36 so that pressure beneath the bucket continues to drop. At some point, pressure will become low enough to cause downward movement of the bucket due to the pressure differential across fin 46. As the bucket moves down, pressure in cavity 53 substantially decreases since the top of the bucket is sealed by plunger 48. This pressure decrease in cavity 53 permits valve 44 to open, thus drawing fluid into the cavity. Likewise, the pressure decrease maintains valve 54 in a closed position, preventing movement of fluid into pipe 50 until the bucket once again begins upward movement.

The two-stroke pump attached to manifold 64 continues its two-stroke action—alternately raising and lowering the fluid pressure between the casing and the tubing, and hence alternately raising and lowering the bucket. Such action, with the resultant alternating fluid flow through holes 36 is referred to herein as "rocking" the fluid between casing 14 and tubing 16. Each time the bucket is raised, a full bucket of fluid is ejected into pipe 50 and upward into tubing 16. In this manner, fluid is pumped from pool 18 to tubing top 20. It is to be appreciated that the power required to drive the two-stroke pump attached to manifold 64 is substantially less than that of conventional downhole pumps. The power requirement is simply that required to lift the bucket from its lowest position to its highest position. In conventional pumps the power requirement is that necessary to support a column of fluid along the entire length of tubing 16. In a well of several thousand feet or greater, this power requirement is very high.

It should also be noted that precision machining is not required to manufacture the instant pump. Fluid-tight seals between fin 46 and tubing 16 as well as seals between pipe 50 and bucket sides 40 are not necessary for proper operation of the pump, since the pump operates without great pressure differentials and slight fluid leakage does not impair pump efficiency.

Thus, an easily manufactured downhole pump having a low operating power requirement has been shown. While the invention has been particularly shown and described with reference to the foregoing preferred embodiment, it will be understood by those skilled in the art that other changes in form and detail may be made therein without departing from the spirit and scope of the invention as defined in the appended claims.

What is claimed is:

1. A downhole pump for lifting fluid from an underground chamber comprising:

a casing extending upwardly from the chamber;

a tubing coaxially aligned within said casing, said tubing including holes located adjacent the lower end thereof;

a floor mounted on the bottom of said casing, said floor including a check valve for permitting upward flow only into said tubing;

a movable bucket having a cylindrical side, a bottom, and an open top, said bucket being positioned over said floor and including a check valve for permitting upward flow only mounted on the bottom thereof; 'an annular fin extending from the side of said bucket, said fin being of a size which constrains said bucket to vertical movement along the tubing axis;

an annular plunger over which said bucket slides, said plunger being positioned over said bucket and including a bottom having a check valve mounted thereon for permitting only upward fluid flow; and plunger support means mounted on said tubing wall for fixedly supporting said plunger;

said tubing holes permitting fluid flow between said casing and said tubing during bucket movement.

2. A pump for raising fluid comprising:

a bottom, having an upward-flow check valve mounted thereon, for insertion into the fluid to be raised;

a pump body mounted on and extending upwardly from said bottom;

a fluid-filled casing surrounding said body;

a vessel constrained within said body for vertical movement, said vessel including a bottom having an upward-flow check valve mounted thereon;

said body including holes therein beneath said vessel to permit fluid communication between the lower interior of the body and said casing;

a plunger mounted on the inside of said body above said vessel, said plunger including a bottom having an upward-flow check valve mounted thereon, said plunger being of a size which permits said vessel to ride thereover; and a pump adapted to alternately compress and draw on the fluid in said casing for moving said vessel between a position in which said plunger substantially fills said vessel to a lower position in which substantially none of the plunger is within said vessel.

3. A pump for raising fluid comprising:

a bottom, having an upward-flow check valve mounted thereon, for insertion into the fluid to be raised;

a pump body mounted on and extending upwardly from said bottom, said body including an aperture formed in the lower portion thereof for providing fluid communication between the interior and exterior thereof;

a vessel constrained within said body for vertical movement, said vessel including a bottom having an upward-flow check valve mounted thereon;

a plunger mounted on the inside of said body above said vessel, said plunger including a bottom having an upward-flow check valve mounted thereon, said plunger being of a size which permits said vessel to ride thereover; and means for rocking the fluid surrounding said pump body.

4. The apparatus of claim 3 which further includes a fluid-filled casing surrounding said body and wherein said rocking means is a pump which alternately compresses and draws on the fluid in said casing.

5. In a well of type having an outer casing which extends upwardly from a fluid pool, a coaxially aligned tubing for transporting fluid thereup, and fluid filling the space between said tubing and casing, a downhole pump comprising:

a bottom mounted on said casing and tubing at a point beneath the top of said fluid pool;

a first valve means mounted on said bottom for permitting fluid movement from said pool into said tubing only when the pressure on the tubing side of the bottom is less than the pool pressure;

a vessel positioned above said bottom within said tubing, said vessel having an open top and a closed bottom and a fin extending from the side thereof so that a pressure differential across said fin causes upward or downward movement of said vessel;

a second valve means mounted on said vessel bottom for permitting fluid movement from said tubing into said vessel only when the pressure in said vessel is less than the pressure in said tubing;

a lower portion formed in said casing having holes therein to permit fluid communication between said casing and said tubing, said portion located above said bottom and below said fin;

a vessel seal mounted on said tubing for cooperating with said vessel so as to form a cavity having a volume which decreases with upward movement of said vessel and increases with downward movement;

a third valve means mounted on said vessel seal for permitting fluid movement from such a formed cavity only when the pressure in such cavity is greater than the pressure above said seal;

a pump connected to the space between said casing and said tubing;

said pump being operable to pull the fluid between said casing and tubing for drawing fluid from said tubing through said holes thereby lowering and filling the vessel; and said pump then being operable to push the fluid between said casing and tubing for forcing fluid from said casing through said holes thereby forcing the vessel upward and the fluid therein through the third valve means.

6. The apparatus of claim 5 wherein said vessel side is cylindrical and wherein said fin is annularly shaped and extends between the vessel side and tubing wall.

7. The apparatus of claim 6 wherein said vessel seal includes a disc having a hole centered therein, said disc being mounted on the interior wall of said tubing substantially normal thereto, and wherein said seal further includes a pipe having a bottom on which said third valve means is mounted, said pipe being mounted on the underside of said disc in axial alignment with said hole and being of a size which permits said vessel to fit thereover.

* * * * *

UNITED STATES PATENT AND TRADEMARK OFFICE

CERTIFICATE OF CORRECTION

PATENT NO. : 4,421,463

DATED : December 20, 1983

INVENTOR(S) : Bert Lee

It is certified that error appears in the above-identified patent and that said Letters Patent are hereby corrected as shown below:

In the abstract, line 2 change "aligning" to --aligned--.

In column 2, line 7 change "shown" to --show--.

In column 2, line 9 change "continuous" to --continuation--.

In column 4, claim 1, line 57 delete the apostrophe before the "an" and begin a new paragraph after the ";" and before the "an".

Signed and Sealed this

*Twenty-eighth* Day of *February 1984*

[SEAL]

*Attest:*

GERALD J. MOSSINGHOFF

*Attesting Officer*

*Commissioner of Patents and Trademarks*